US010065825B2

(12) United States Patent
Matsumoto

(10) Patent No.: US 10,065,825 B2
(45) Date of Patent: Sep. 4, 2018

(54) PAPER SHEET STACKING MECHANISM AND PAPER SHEET HANDLING DEVICE

(71) Applicant: GLORY LTD., Himeji-shi, Hyogo (JP)

(72) Inventor: Eiji Matsumoto, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/458,108

(22) Filed: Mar. 14, 2017

(65) Prior Publication Data

US 2017/0267482 A1 Sep. 21, 2017

(30) Foreign Application Priority Data

Mar. 18, 2016 (JP) ..... 2016-055287

(51) Int. Cl.

| | |
|---|---|
| ***B65H 29/20*** | (2006.01) |
| ***B65H 29/40*** | (2006.01) |
| ***G07D 11/00*** | (2006.01) |
| ***B65H 29/52*** | (2006.01) |

(52) U.S. Cl.

CPC ..... *B65H 29/40* (2013.01); *B65H 29/52* (2013.01); *G07D 11/0033* (2013.01); *B65H 2301/33214* (2013.01); *B65H 2301/4212* (2013.01); *B65H 2301/44765* (2013.01); *B65H 2404/654* (2013.01); *B65H 2404/655* (2013.01); *B65H 2404/656* (2013.01); *B65H 2404/659* (2013.01); *B65H 2701/1912* (2013.01)

(58) Field of Classification Search

None

See application file for complete search history.

(56) References Cited

U.S. PATENT DOCUMENTS

| | | | | |
|---|---|---|---|---|
| 4,603,849 | A * | 8/1986 | Nakamura | B65H 29/40 271/186 |
| 6,619,653 | B2 * | 9/2003 | Dobrindt | B65H 29/40 271/187 |
| 2002/0063378 | A1 * | 5/2002 | Dobrindt | B65H 29/40 271/187 |
| 2004/0245718 | A1 | 12/2004 | Dobrindt | |
| 2015/0061221 | A1 * | 3/2015 | Haberstroh | B65H 29/40 271/315 |
| 2015/0175375 | A1 * | 6/2015 | Jiang | B65H 29/125 414/794.8 |

(Continued)

FOREIGN PATENT DOCUMENTS

| | | | |
|---|---|---|---|
| JP | 2009-220946 | A | 10/2009 |
| JP | 2017043479 | A * | 3/2017 |
| JP | 2009-220946 | | 11/2017 |

*Primary Examiner* — Prasad V Gokhale

(74) *Attorney, Agent, or Firm* — Renner, Kenner, Greive, Bobak, Taylor & Weber

(57) ABSTRACT

An objective of the present disclosure is to prevent paper sheets from being folded or damaged when the paper sheets are stacked. A paper sheet stacking mechanism (banknote stacking mechanism 50) includes stacking wheels 52, rotary rollers 54, a transport mechanism 70 configured to insert a paper sheet between vanes 52*b* of the stacking wheels, and a guide (center guide 55) having a guide surface 551 configured to guide the paper sheet. The guide surface has a curved shape having a diameter about a rotary shaft, and the diameter gradually increases from an upstream side toward a downstream side in a rotation direction of the stacking wheels.

12 Claims, 13 Drawing Sheets

(56) References Cited

U.S. PATENT DOCUMENTS

| | | | | |
|---|---|---|---|---|
| 2015/0203318 | A1* | 7/2015 | Deng | B65H 31/38<br>271/83 |
| 2016/0163143 | A1* | 6/2016 | Mizoro | B65H 29/40<br>271/306 |
| 2017/0309111 | A1* | 10/2017 | Mizoro | G07D 11/0033 |

* cited by examiner

PAPER SHEET STACKING MECHANISM AND PAPER SHEET HANDLING DEVICE

CROSS REFERENCE TO RELATED APPLICATION

The disclosure of Japanese Patent Application No. 2016-055287, filed on Mar. 18, 2016, is incorporated herein by reference.

BACKGROUND OF THE INVENTION

Field of the Invention

The technique disclosed herein relates to paper sheet stacking mechanisms and paper sheet handling devices.

Description of the Background Art

Japanese Laid-Open Patent Publication No. 2015-26118 (hereinafter referred to as Patent Literature 1) discloses a paper sheet handling device including a paper sheet stacking mechanism configured to stack, therein, paper sheets such as banknotes, checks, negotiable instruments, and the like. The paper sheet stacking mechanism is provided with: a pair of stacking wheels; two rollers provided on the sides of the respective stacking wheels so as to be coaxial with the stacking wheels; and transport belts provided to be opposed to the rollers. Each stacking wheel has a base, and a plurality of vanes extending outward from an outer circumferential surface of the base in a direction opposite to a rotation direction of the stacking wheel. Paper sheets are inserted between the vanes of the stacking wheels, and the stacking wheels transport the paper sheets one by one to a stacking unit. The two rollers rotate at an angular velocity greater than that of the stacking wheels. The transport belts and the rollers nip the paper sheets, and the paper sheets are transported by a driving force of the transport belts to be inserted between the vanes of the stacking wheels. In this paper sheet stacking mechanism, each paper sheet is assuredly inserted between the vanes of the stacking wheels, and the inserted paper sheet is prevented from being pushed out from between the vanes due to an elastic restoring force of the paper sheet. This paper sheet stacking mechanism can stably stack the paper sheets in the stacking unit.

The paper sheet stacking mechanism disclosed in Patent Literature 1 further includes a first auxiliary roller and second auxiliary rollers. The first auxiliary roller has a diameter larger than the diameter of the base of each stacking wheel, and is provided between the pair of stacking wheels so as to be rotatable. A leading end portion of a paper sheet inserted between the vanes of the stacking wheels by the transport belts and the rollers comes into contact with an outer circumferential surface of the first auxiliary roller. The first auxiliary roller prevents the paper sheet from being excessively inserted between the vanes of the stacking wheels.

The second auxiliary rollers each have a diameter smaller than the diameter of the two rollers, and are provided on the sides of the two rollers, respectively. The second auxiliary rollers prevent both end portions of a paper sheet from being folded while the stacking wheels are rotating or from being caught in a gap in the stacking unit.

The paper sheet stacking mechanism disclosed in Patent Literature 1 is effective in terms of stably stacking the paper sheets in the stacking unit, particularly in a structure having miniaturized stacking wheels.

Meanwhile, the inventor of the present disclosure has found through an investigation that, if the rotation speed of the stacking wheels is increased in the paper sheet stacking mechanism disclosed in Patent Literature 1 having the miniaturized stacking wheels, paper sheets may be folded or the leading ends of paper sheets may be damaged.

The technique disclosed herein is made in view of the aforementioned problem, and an object of the technique is to prevent paper sheets from being folded or damaged when the paper sheets are stacked.

According to the investigation of the inventor of the present disclosure, it is found that, if the rotation speed of the stacking wheels is increased in the paper sheet stacking mechanism disclosed in Patent Literature 1, a paper sheet to be forcibly inserted between the vanes of the stacking wheels by the driving force of the transport belts is excessively inserted between the vanes, which causes the paper sheet to be folded or damaged.

That is, in the paper sheet stacking mechanism disclosed in Patent Literature 1, the roller is disposed on one side of each stacking wheel, and the first auxiliary roller is disposed on the other side of the stacking wheel. The roller and the auxiliary roller each have a diameter larger than the diameter of the base of the stacking wheel.

On the other hand, a gap between a vane and a neighbouring vane in each stacking wheel is provided so as to extend outward in a direction opposite to the rotation direction of the stacking wheel from the outer circumferential surface of the base of the stacking wheel. Therefore, the greater the amount of insertion of a paper sheet between the vanes of the stacking wheel is, the more the paper sheet is shifted radially inward in the stacking wheel.

The paper sheet inserted between the vanes of the stacking wheels is nipped between the vanes and the outer circumferential surfaces of the rollers and between the vanes and the outer circumferential surface of the first auxiliary roller. That is, the outer circumferential surfaces of the rollers and the outer circumferential surface of the first auxiliary roller come into contact with a face, of the paper sheet, facing radially inward, and the vanes come into contact with a face, of the paper sheet, facing radially outward. Thereby, the paper sheet is bent in a wave-like shape between the stacking wheels, the rollers, and the first auxiliary roller, and is held between the vanes of the stacking wheels against an elastic restoring force of the paper sheet. Even when the stacking wheels are miniaturized and the rotation speed thereof is increased, it is possible to stably hold the paper sheet between the vanes of the stacking wheels if the paper sheet is, inserted to a moderate extent between the vanes.

However, as described above, the greater the amount of insertion of the paper sheet inserted between the vanes of the stacking wheels is, the more the paper sheet is shifted radially inward in the stacking wheels. Therefore, if the paper sheet is excessively inserted between the vanes, the position at which the outer circumferential surfaces of the rollers and the outer circumferential surface of the first auxiliary roller come into contact with the face, of the paper sheet, facing radially inward, greatly deviates in the radial direction from the position at which the vanes come into contact with the face, of the paper sheet, facing radially outward. That is, the paper sheet, which is shaped in a wave-like shape by being nipped between the vanes and the outer circumferential surfaces of the rollers and between the vanes and the outer circumferential surface of the first auxiliary roller, is greatly bent so as to increase the amplitude of the wave, which causes the paper sheet to be folded.

Furthermore, the greater the amount of insertion of the paper sheet inserted between the vanes of the stacking wheels is, the more the holding force for holding the paper sheet between the vanes is increased, whereby the paper sheet can be stably held between the vanes of the stacking wheels as described above.

With rotation of the stacking wheels, the leading end of the paper sheet held between the vanes hits a stopper, so that the paper sheet comes off from the vanes and is stacked in the stacking unit. With increase in the rotation speed of the stacking wheels, an impact force generated when the leading end of the paper sheet hits the stopper is increased. In addition, as the amount of insertion of the paper sheet is greater and the holding force is greater, the paper sheet cannot easily come off from the vanes when the leading end thereof hits the stopper. Thus, the leading end of the paper sheet is damaged.

Therefore, the inventor of the present disclosure prevents a paper sheet from being folded and/or damaged, by preventing excessive insertion of the paper sheet between the vanes of the stacking wheel.

SUMMARY OF THE INVENTION

Specifically, a technique disclosed herein relates to a paper sheet stacking mechanism. The paper sheet stacking mechanism includes: a stacking unit configured to stack paper sheets therein; a pair of stacking wheels provided to be rotatable about a rotary shaft, each stacking wheel having vanes extending outward in a direction opposite to a rotation direction of the stacking wheel, the pair of stacking wheels being configured to transport a paper sheet inserted between the vanes to the stacking unit; two rotary rollers rotatably provided outside and adjacent to the pair of stacking wheels, the rotary rollers being configured to transport the paper sheet to the stacking unit in cooperation with the stacking wheels; transport units provided to be opposed to the two rotary rollers, respectively, the transport units being configured to transport the paper sheet nipped between the transport units and the rotary rollers, at a speed higher than a rotation speed of the stacking wheels, thereby to insert the paper sheet between the vanes of the stacking wheels; and a guide provided between the pair of stacking wheels, the guide having a guide surface configured to guide the paper sheet by coming into contact with a face of the paper sheet that is inserted between the vanes of the stacking wheels by the transport units and transported in accordance with rotation of the stacking wheels. The guide surface has a curved shape having a diameter, about the rotary shaft, gradually increasing from an upstream side toward a downstream side in the rotation direction of the stacking wheels.

According to this configuration, the two rotary rollers provided outside and adjacent to the respective stacking wheels transport the paper sheet in cooperation with the transport mechanism, whereby the paper sheet is inserted between the vanes of the stacking wheels. Since the paper sheet is forcibly inserted between the vanes, it is possible to assuredly insert the paper sheet between the stacking wheels, and it is possible to prevent the paper sheet from being pushed out from between the vanes due to an elastic restoring force of the paper sheet.

The guide with the guide surface having a curved shape is provided between the pair of stacking wheels. The diameter of the guide surface about the rotary shaft gradually increases from the upstream side toward the downstream side in the rotation direction of the stacking wheels. The greater the amount of insertion of the paper sheet inserted between the vanes of the stacking wheels is, the more the paper sheet is shifted radially inward in the stacking wheels. However, since the diameter of the guide surface gradually increases, the paper sheet comes into contact with the guide surface and thereby the radially inward movement of the paper sheet is suppressed. As a result, the paper sheet is prevented from being excessively inserted between the vanes.

Therefore, the paper sheet nipped between the vanes and the outer circumferential surfaces of the rotary rollers is prevented from being folded due to excessive insertion of the paper sheet between the vanes.

Further, since the paper sheet is not excessively inserted between the vanes, a holding force for holding the paper sheet between the vanes is prevented from being excessively great, thereby preventing the leading end of the paper sheet from being damaged when the paper sheet comes off from between the vanes.

Thus, even when the speed of the paper sheet stacking mechanism is increased, folding and/or damage of the paper sheet are prevented from occurring when the paper sheet is stacked.

The rotary rollers may be configured to transport the paper sheet to the stacking unit in cooperation with the stacking wheels, while keeping the paper sheet being inserted between the vanes by nipping the paper sheet between the rotary rollers and the vanes so that the paper sheet is shaped in a wave-like shape. The guide surface may have a first region and a second region. The first region is a region located on the upstream side in the rotation direction of the stacking wheels. The first region has the same shape as a trajectory of a leading end of the paper sheet inserted between the vanes, which paper sheet is transported in accordance with the rotation of the stacking wheels while being inserted between the vanes of the stacking wheels, or a shape having a diameter smaller than a diameter of the trajectory. The first region allows the paper sheet to be inserted between the vanes. The second region is a region located downstream of the first region in the rotation direction of the stacking wheels. The second region has a shape having a diameter larger than the diameter of the trajectory of the leading end of the paper sheet inserted between the vanes. The second region restricts insertion of the paper sheet between the vanes.

In this configuration, the rotary rollers are configured to nip the paper sheet with the vanes so that the paper sheet is shaped in a wave-like shape. The rotary roller may be configured to have a diameter larger than the diameter of a base of each stacking wheel. By being nipped between the rotary rollers and the stacking wheels, the paper sheet is kept inserted between the vanes, and transported to the stacking unit in accordance with rotation of the stacking wheels.

The guide surface has the first region and the second region. The first region is a region located on the upstream side in the rotation direction of the stacking wheels. The first region has the same shape as a trajectory of a leading end of the paper sheet inserted between the vanes, which paper sheet is transported in accordance with the rotation of the stacking wheels while being inserted between the vanes of the stacking wheels, or a shape having a diameter smaller than a diameter of the trajectory. The first region of the guide surface allows the paper sheet to be inserted between the vanes. The paper sheet is assuredly inserted between the vanes by coming into contact with the first region of the guide surface, and being guided.

The second region of the guide surface is a region located downstream of the first region in the rotation direction of the stacking wheels. The second region has a shape having a diameter larger than the diameter of the trajectory of the leading end of the paper sheet inserted between the vanes.

The greater the amount of insertion of the paper sheet inserted between the vanes of the stacking wheels is, the more the paper sheet is shifted radially inward in the stacking wheels. However, since the diameter of the second region has a diameter larger than the diameter of the trajectory of the leading end of the paper sheet, the paper sheet comes into contact with the second region and thereby the radially inward movement of the paper sheet is suppressed. As a result, insertion of the paper sheet between the vanes is restricted.

The paper sheet is sufficiently inserted between the vanes in the first region, and insertion of the paper sheet between the vanes is restricted in the second region located downstream of the first region in the rotation direction of the stacking wheels, whereby the paper sheet is prevented from being excessively inserted between the vanes. As a result, even when the speed of the paper sheet stacking mechanism is increased, folding and/or damage of the paper sheet are prevented from occurring when the paper sheet is stacked.

The paper sheet stacking mechanism may include a stopper configured to extract the paper sheet from between the vanes and stack the paper sheet in the stacking unit when the leading end of the paper sheet transported in accordance with rotation of the stacking wheel hits the stopper. The guide may include a holding force reduction structure configured to reduce, in front of the stopper, a holding force for holding the paper sheet nipped between the guide surface and the vanes.

Since the guide surface of the guide provided between the pair of stacking wheels has a shape having a gradually increasing diameter, when a paper sheet is nipped between the vanes of the stacking wheels and the guide surface, the angle of bending of the paper sheet that is bent in a wave-like shape is relatively increased, whereby the holding force is likely to be increased.

If the paper sheet hits the stopper with the holding force being increased, the leading end of the paper sheet may be damaged as described above.

In the above configuration, the guide has the holding force reduction structure which reduces the holding force for holding the paper sheet in front of the stopper. According to this configuration, since the holding force is reduced when the paper sheet hits the stopper, the leading end of the paper sheet is prevented from being damaged when hitting the stopper.

The holding force reduction structure may be a structure which causes a space between the guide surface and each stacking wheel to be increased by reducing, in front of the stopper, a width of the guide surface in the direction of the rotary shaft.

The larger the angle of bending of the paper sheet is when the paper sheet is nipped between the guide surface and the vanes and bent in a wave-like shape, the greater the holding force is. When the space between the guide surface and each stacking wheel is increased, the angle of bending in the wave-like shape is reduced, whereby the holding force is reduced.

The holding force reduction structure may be a structure which causes the diameter of the guide surface to be reduced in front of the stopper.

When the diameter of the guide surface is reduced, the amplitude of the wave of the paper sheet bent in a wave-like shape is reduced and thereby the angle of bending to the wave-like shape is reduced, whereby the holding force is reduced.

The holding force reduction structure may be a structure that causes the guide surface to be eliminated in front of the stopper.

When the guide surface is eliminated in front of the stopper, a paper sheet is not nipped between the guide surface and the vanes, whereby the holding force is reduced.

The paper sheet stacking mechanism may include second guides provided outside the two rotary rollers, respectively. Each second guide has a second guide surface that is curved around the rotary shaft and is configured to guide the paper sheet when coming into contact with a face of the paper sheet that is inserted between the vanes of the stacking wheels by the transport unit and transported in accordance with rotation of the stacking wheels.

Since the second guide surface of each second guide comes into contact with the face of the paper sheet at both end portions of the paper sheet, the both end portions of the paper sheet are prevented from being folded or being caught in gaps provided outside the rotary rollers.

The paper sheet stacking mechanism may include two second stacking wheels provided outside and adjacent to the two rotary rollers so as to be coaxial with the stacking wheels and rotatable. Each second stacking wheel has vanes extending outward in a direction opposite to a rotation direction of the second stacking wheel. The second stacking wheels are configured to transport the paper sheet inserted between the vanes to the stacking unit in cooperation with the stacking wheels.

Providing four stacking wheels in total enables stable transport of paper sheets to the stacking unit.

The paper sheet stacking mechanism may include two second stacking wheels provided outside and adjacent to the two rotary rollers so as to be coaxial with the stacking wheels and rotatable. Each second stacking wheel has vanes extending outward in a direction opposite to a rotation direction of the second stacking wheel. The second stacking wheels are configured to transport the paper sheet inserted between the vanes to the stacking unit in cooperation with the stacking wheels. The second guides may be provided outside and adjacent to the second stacking wheels, respectively.

The transport mechanism may include transport belts that are in contact with the rotary rollers. Thus, it is possible to assuredly insert the paper sheet between the vanes of the stacking wheels.

Friction members may be provided on outer circumferential surfaces of the rotary rollers. Thus, the paper sheet can be assuredly inserted between the vanes of the stacking wheels, and the inserted paper sheet is assuredly prevented from being pushed out from between the vanes.

A technique disclosed herein relates to a paper sheet handling device including the above-described paper sheet stacking mechanism.

According to the paper sheet stacking mechanism and the paper sheet handling device described above, it is possible to prevent paper sheets from being folded and/or damaged when the paper sheets are stacked.

DESCRIPTION OF THE PREFERRED EMBODIMENTS

Figure 1:
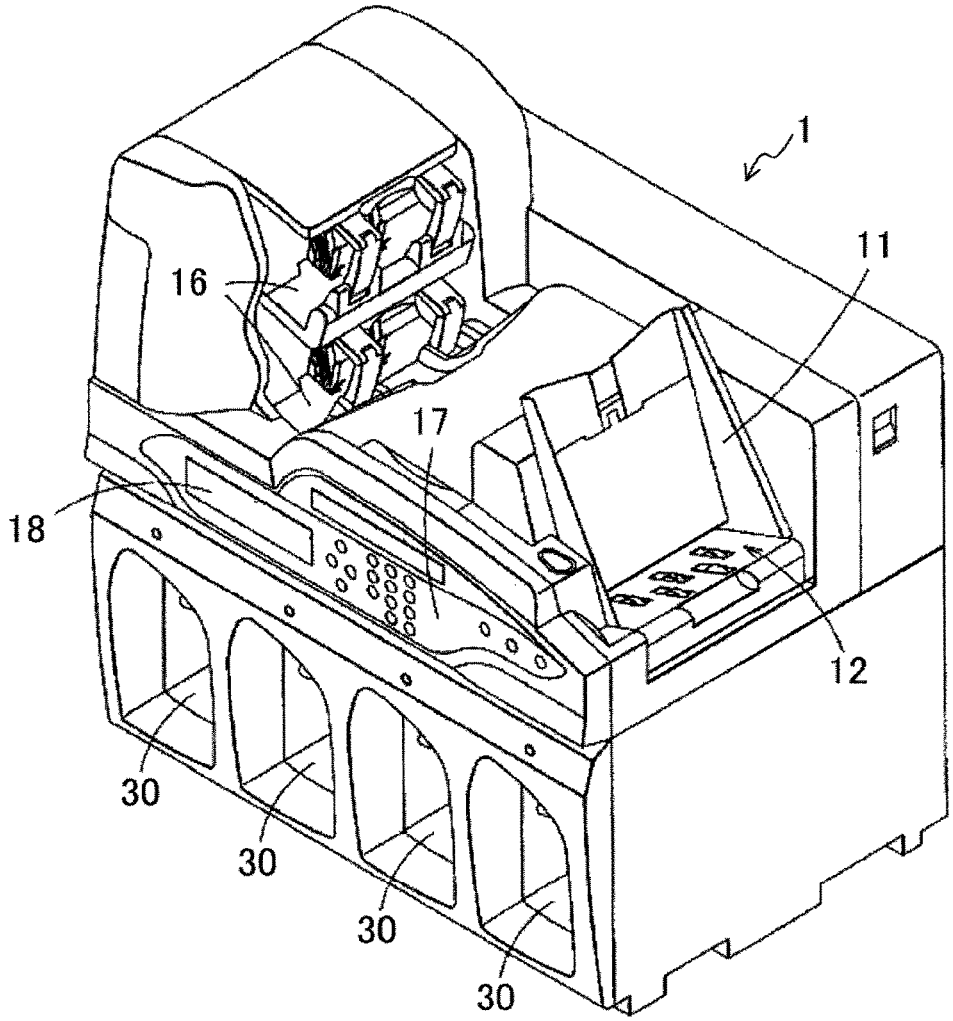
FIG. 1 is a perspective view showing the appearance of a banknote processing machine.
Figure 2:
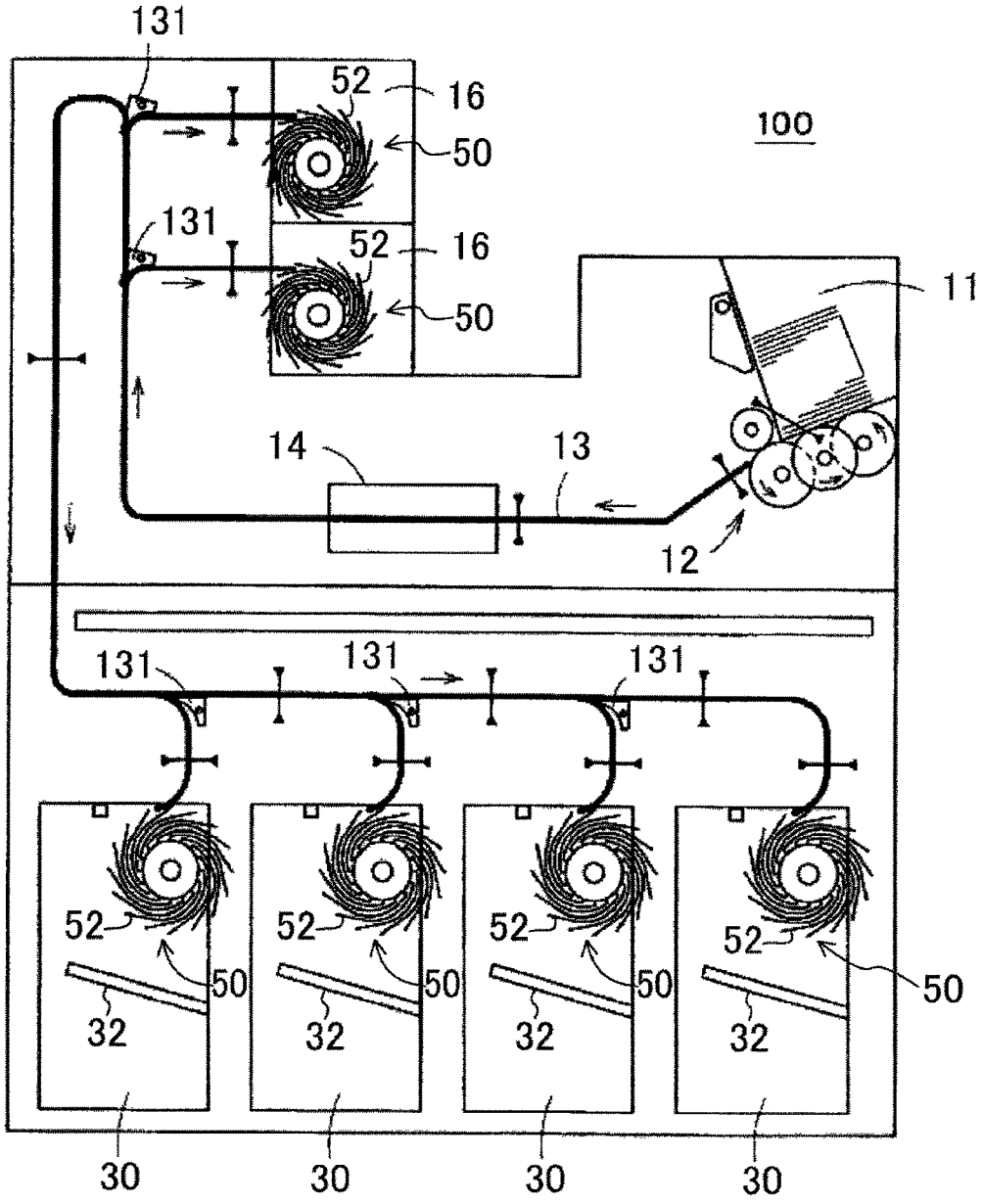
FIG. 2 is a conceptual diagram showing the structure of the banknote processing machine.

A paper sheet stacking mechanism and a paper sheet handling device that are disclosed herein will be described below in detail with reference to the drawings. The following description is an example. FIG. 1 is a perspective view showing the appearance of the paper sheet handling device. FIG. 2 shows the structure of the paper sheet handling device. This paper sheet handling device is a banknote processing machine 1 having a function of sorting banknotes according to kinds and/or states of the banknotes. The banknote processing machine 1 is configured to take in loose banknotes, and count and sort the banknotes.

Overall Structure of Banknote Processing Machine

The banknote processing machine 1 includes: a hopper 11 on which a plurality of banknotes to be counted are placed in a stacked state; a feeding unit 12 configured to feed the lowermost banknote among the plurality of banknotes placed on the hopper 11, one by one, into a housing; a transport unit 13 provided inside the housing and configured to transport, one by one, the banknotes fed into the housing by the feeding unit 12; a recognition unit 14 provided in the middle of the transport unit 13 and configured to recognize and count the banknotes fed into the housing by the feeding unit 12; a plurality of (four (first to fourth) in the illustrated example) stacking units 30 configured to stack, therein, the banknotes recognized by the recognition unit 14; and a plurality of (two in the illustrated example) reject units 16 configured to stack, therein, banknotes that have been determined not to be stacked in the stacking units 30.

The recognition unit 14 recognizes the authenticity, fitness, denomination, and the like of banknotes, recognizes whether or not abnormal transport of banknotes has occurred, and counts the banknotes. The recognition unit 14 judges whether each banknote is a banknote to be stacked in the stacking units 30 or a banknote not to be stacked in the stacking units 30.

Each stacking unit 30 is configured such that banknotes are stored in a stacked manner in an up-down direction, on a stacking plate 32. The four (first to fourth) stacking units 30 are arranged side by side in a horizontal direction, in a lower part of the banknote processing machine 1. Specifically, the first to fourth stacking units 30 are arranged in order from the left side to the right side of the surface of the sheet of FIG. 2. Adjacent stacking units 30 are partitioned from each other, and each stacking unit 30 has an outlet that is open at a side surface of the banknote processing machine 1. Banknotes stacked in each stacking unit 30 can be taken out through the outlet.

Each reject unit 16 is configured to stack, therein, banknotes in the up-down direction. Each reject unit 16 is provided in an upper part of the banknote processing machine 1 such that the reject unit 16 and the hopper 11 are arranged side by side in the horizontal direction. The two reject unit 16*s* are arranged in the up-down direction. Banknotes stacked in the upper reject unit 16 and banknotes stacked in the lower reject unit 16 can be taken out from the respective reject units 16.

The transport unit 13 includes a transport path formed by combining a plurality of transport belts and a plurality of rollers which are not shown in detail. The transport unit 13 drives the transport belts with banknotes being nipped between the transport belts and the rollers, thereby transporting the banknotes along the transport path. Each banknote is transported such that one long edge thereof is a leading end. The transport path extends from the hopper 11 to the fourth stacking unit 30 located at the rightmost side of the banknote processing machine in FIG. 2.

The transport path has a plurality of diversion points, and a diverter 131 is disposed at each diversion point. Each diverter 131 is configured to selectively send, to one of two directions, each banknote transported along the transport path. The diversion points in the transport path include: a diversion point to the lower reject unit 16 of the two reject units 16 and a diversion point to the upper reject unit 16 of the two reject units 16; a diversion point to the first stacking unit 30, a diversion point to the second stacking unit 30, and a diversion point to the third stacking unit 30. A banknote that has been recognized and counted by the recognition unit 14 is selectively sent to any of the first to fourth stacking units 30 or any of the upper and lower reject units 16.

Next, the operation of the banknote processing machine 1 will be described. First, an operator places banknotes to be processed by the banknote processing machine 1, in a stacked state on the hopper 11. Thereafter, when the operator instructs the banknote processing machine 1 to start banknote processing, by using an operation unit 17 and a display unit 18 which are provided on a side surface of the banknote processing machine 1, the banknote processing machine 1 feeds, by the feeding unit 12, the banknotes placed in the stacked state on the hopper 11, one by one, to the transport unit 13 in the housing. The banknotes are transported one by one by the transport unit 13.

The banknotes transported by the transport unit 13 are recognized and counted by the recognition unit 14. If a banknote recognized by the recognition unit 14 is a banknote to be stacked, this banknote is further transported by the transport unit 13 to any of the first to fourth stacking units 30 in accordance with a predetermined sorting rule. Since the outlets of the stacking units 30 are always opened, the operator can freely take out banknotes from the stacking units 30.

On the other hand, when the banknote recognized by the recognition unit 14 is a banknote not to be stacked, this banknote is further transported by the transport unit 13 to the upper or lower reject unit 16 in accordance with the predetermined sorting rule. The operator can freely take out banknotes from the reject units 16.

After all the banknotes placed on the hopper 11 are fed in the housing and are transported to the stacking units 30 and/or the reject units 16, the processing for the banknotes by the banknote processing machine 1 is completed.

Structure of Banknote Stacking Mechanism

As shown in FIG. 2, stacking wheels 52 are provided in upper parts of the first to fourth stacking units 30. In addition, stacking wheels 52 are also provided in the upper and lower reject units 16. That is, each of the stacking units 30 and the reject units 16 of the banknote processing machine 1 includes a banknote stacking mechanism 50 as a paper sheet stacking mechanism having the stacking wheel 52. Hereinafter, the structure of the banknote stacking mechanism 50 of the stacking unit 30 will be described in detail with reference to FIG. 3 to FIG. 11, as an example of the banknote stacking mechanism 50. The banknote stacking mechanism 50 of the reject unit 16 has basically the same structure as the banknote stacking mechanism 50 of the stacking unit 30.

In the banknote stacking mechanism 50, the stacking wheel 52 is miniaturized, and speed-up is achieved by setting the rotation speed of the stacking wheel 52 to be relatively high when banknotes are stacked. By miniaturizing the stacking wheel 52, the banknote stacking mechanism 50 is downsized, which is advantageous in downsizing the banknote processing machine 1. In addition, speed-up of the banknote stacking mechanism 50 enables speed-up of processing of the banknote processing machine 1.

Figure 3:
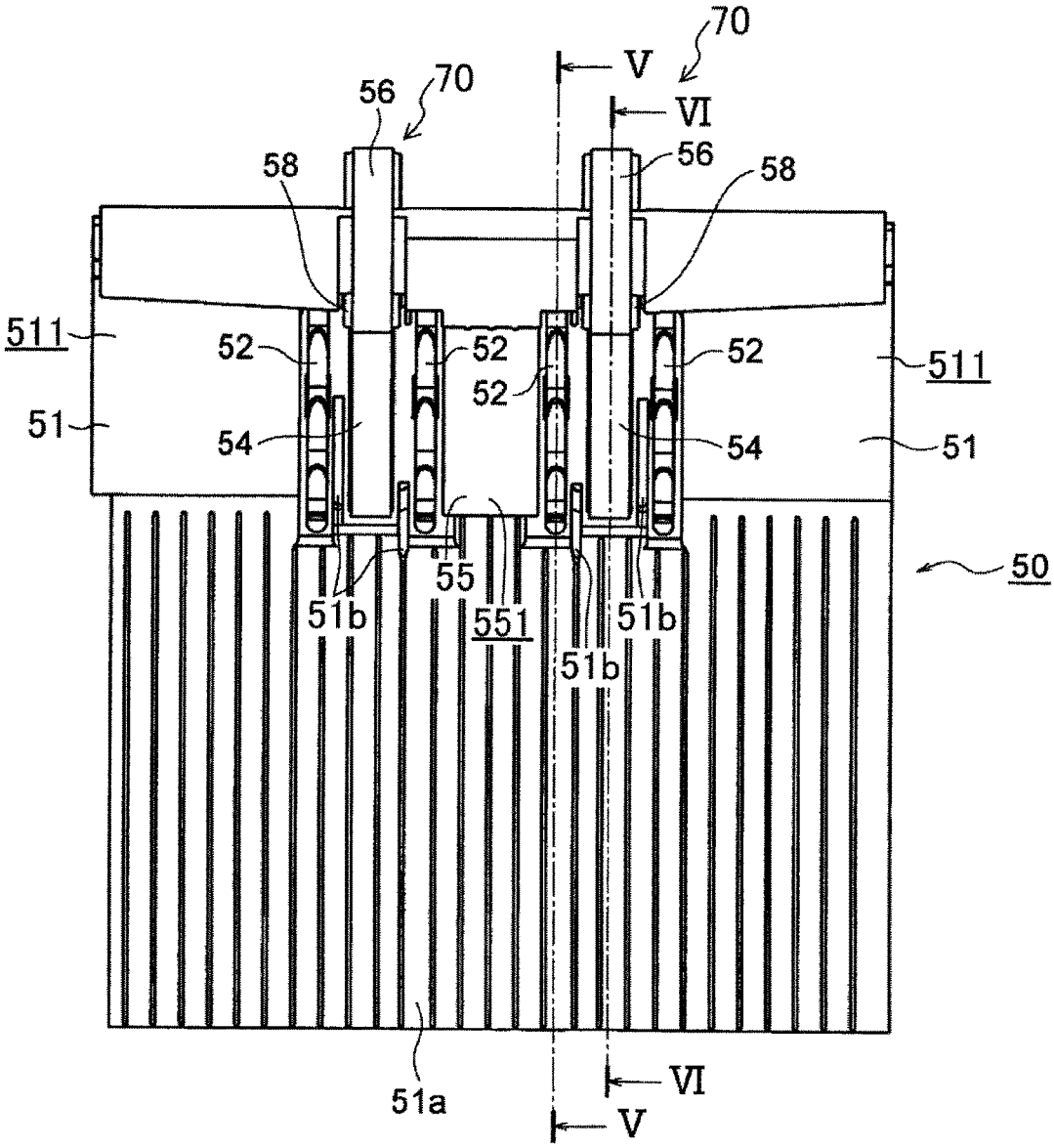
FIG. 3 is a front view showing the structure of a banknote stacking mechanism.
Figure 4:
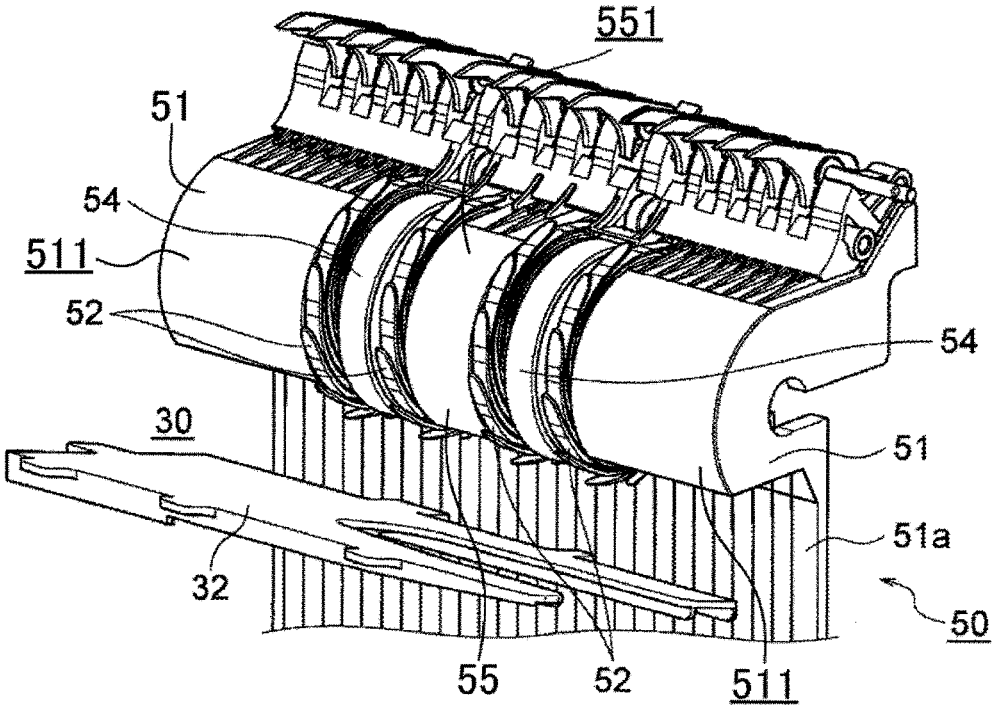
FIG. 4 is a perspective view showing the structure of the banknote stacking mechanism.
Figure 5:
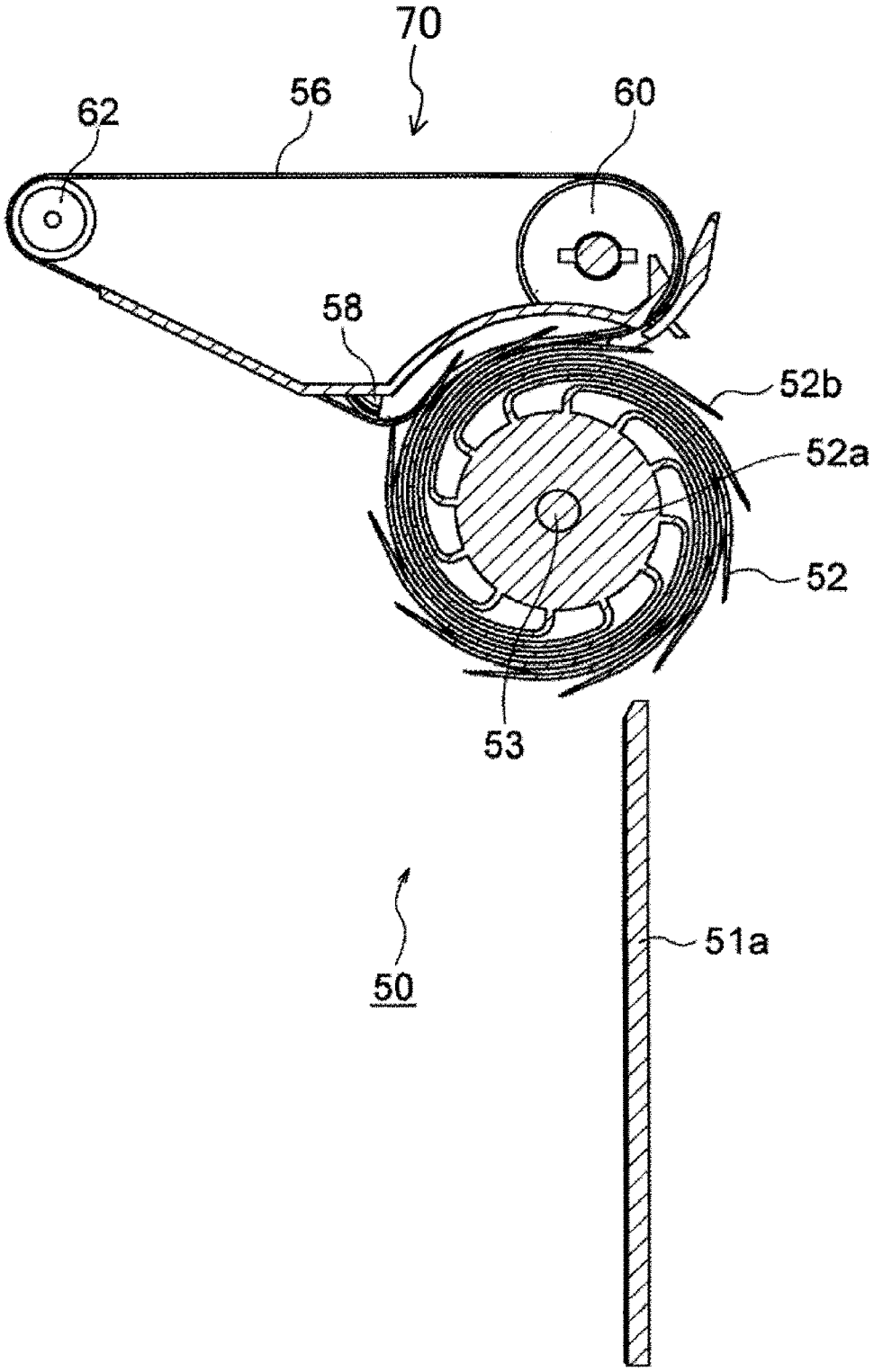
FIG. 5 is a cross-sectional view taken along a line V-V in FIG. 3.
Figure 6:
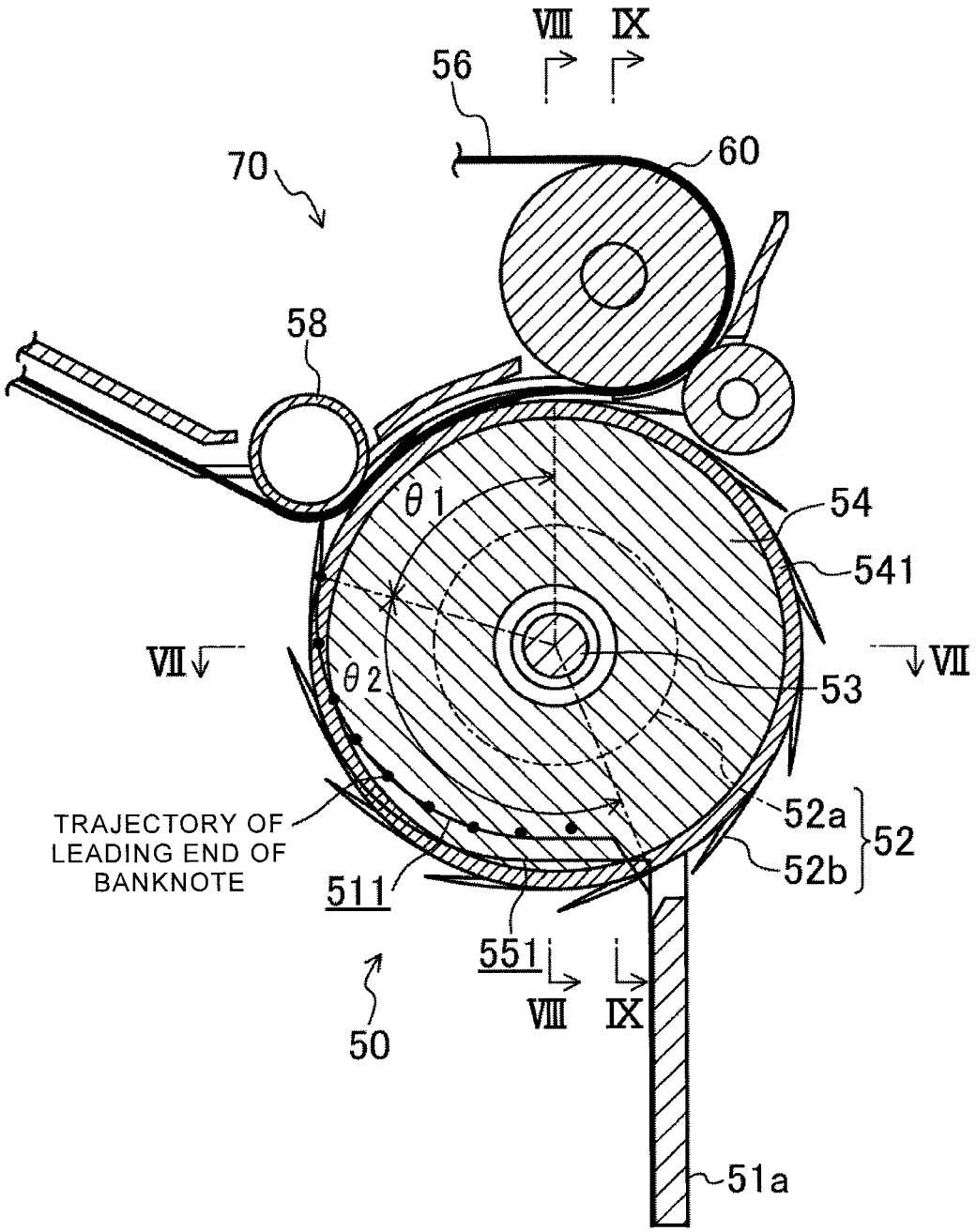
FIG. 6 is an enlarged cross-sectional view of a part at a cross section taken along a line VI-VI in FIG. 3.

FIG. 3 is a front view showing the structure of the banknote stacking mechanism 50. FIG. 4 is a perspective view showing the structure of the banknote stacking mechanism 50. FIG. 5 is a cross-sectional view taken along a line V-V in FIG. 3. FIG. 6 is an enlarged cross-sectional view of a part at a cross section taken along a line VI-VI in FIG. 3.

As shown in FIG. 3, in the banknote stacking mechanism 50, four stacking wheels 52 in total are arranged side by side at predetermined intervals in the horizontal direction. A combination of a rotary roller 54 and a transport belt 56 is provided between two stacking wheels 52 on the left side of the banknote stacking mechanism shown in FIG. 3, and between two stacking wheels 52 on the right side of the banknote stacking mechanism in FIG. 3.

Each stacking wheel 52 is configured to rotate in a counter-clockwise direction in FIG. 5 about a shaft 53 extending in a horizontal direction perpendicular to the surface of the sheet of FIG. 5. Each stacking wheel 52 has a base 52*a* that rotates about the shaft 53, and a plurality of (twelve in the illustrated example) vanes 52*b* that extend outward in a direction opposite to the rotation direction of the base 52*a* from an outer circumferential surface of the base 52*a*. The vanes 52*b* are provided at equal intervals on the outer circumferential surface of the base 52*a*. As described above, the stacking wheel 52 is miniaturized, and specifically, the diameter of a circular region drawn by the tips of the vanes 52*b* when the stacking wheel 52 rotates is smaller than that in the stacking wheel of the conventional structure. Therefore, the stacking wheel 52 has a relatively large curvature of the vanes 52*b*.

Each stacking wheel 52 is configured to rotate in the counter-clockwise direction in FIG. 5 via the shaft 53 by a drive motor (not shown) while the banknote processing machine 1 is operated, and banknotes are transported one by one from the transport unit 13 to the stacking wheel 52. The stacking wheel 52 is configured to receive, between two vanes 52*b*, each banknote transported from the transport unit 13, and transport, to the stacking unit 30, the banknote inserted between the two vanes 52*b*. Specifically, as shown in FIG. 3 and FIG. 4, a stopper 51*a* is provided near the stacking wheels 52, and the leading end of the banknote inserted between the vanes 52*b* of the stacking wheels 52 hits the stopper 51*a* as the stacking wheels 52 rotate, whereby the banknote is discharged from between the vanes 52*b* of the stacking wheels 52 to the outside, and is stacked in the stacking unit 30 in an aligned state. The stopper 51*a* is a wall-shaped member expanding in the up-down direction, and forms a side wall of the stacking unit 30.

As described above, the rotary rollers 54 are disposed between the two stacking wheels 52 on the left side and between the two stacking wheels 52 on the right side (refer to FIG. 3), respectively. As shown in FIG. 6 etc., a friction member 541 made of, for example, rubber is provided on an outer circumferential surface of each rotary roller 54. The diameter of each rotary roller 54, when seen in an axial direction of the shaft 53 of the stacking wheel 52, is configured such that the outer circumferential surface of the rotary roller 54 is located outward relative to the outer circumferential surface of the base 52*a* of the stacking wheel 52 and is located inward relative to the circular region drawn by the tips of the vanes 52*b* of the stacking wheel 52 when the stacking wheel 52 rotates. That is, the diameter of each rotary roller 54 is larger than the diameter of the base 52*a* of the stacking wheel 52 but is smaller than the diameter of the circular region drawn by the tips of the vanes 52*b* of the stacking wheel 52 when the stacking wheel 52 rotates.

Figure 8:
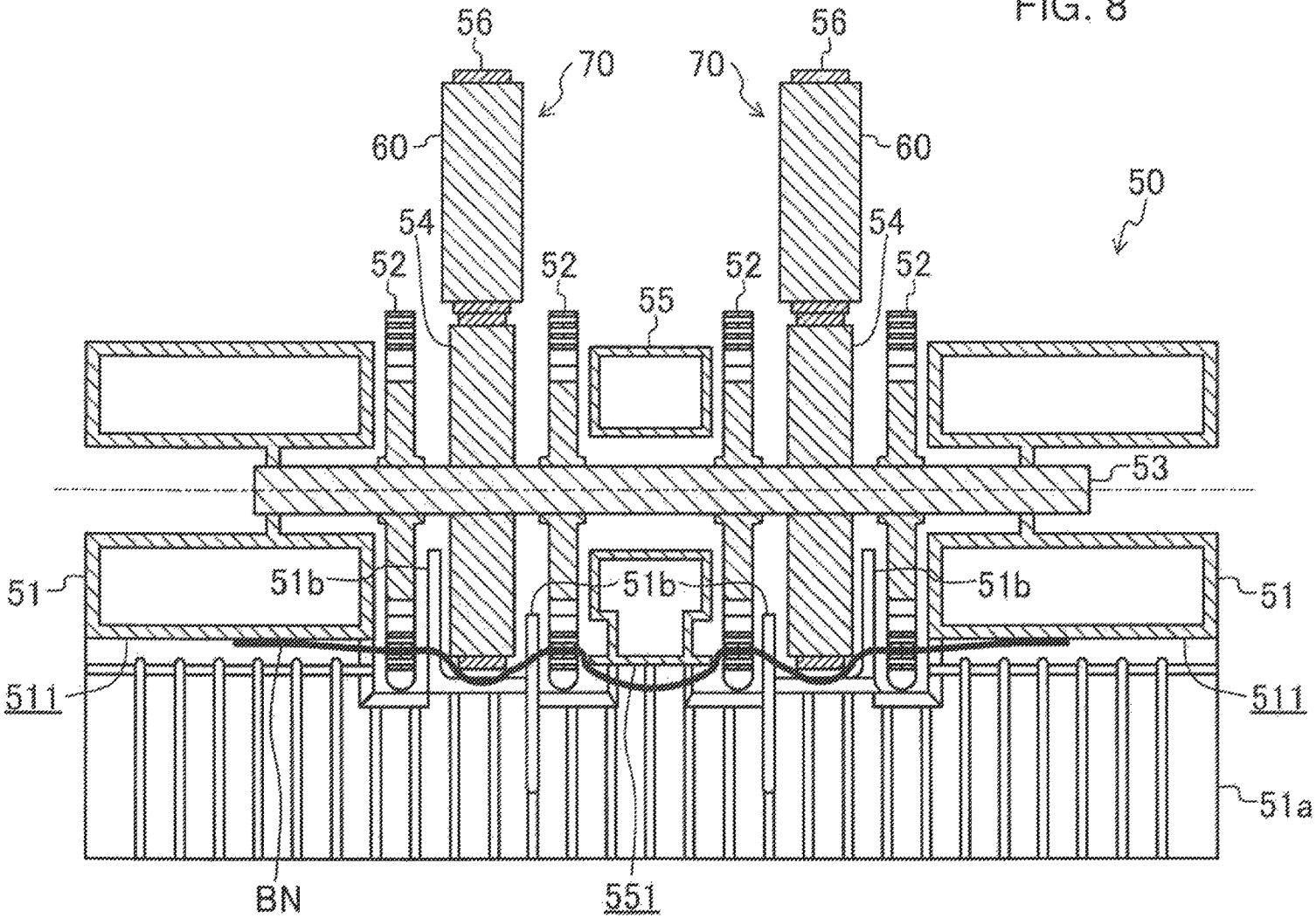
FIG. 8 is a cross-sectional view taken along a line VIII-VIII in FIG. 6.
Figure 9:
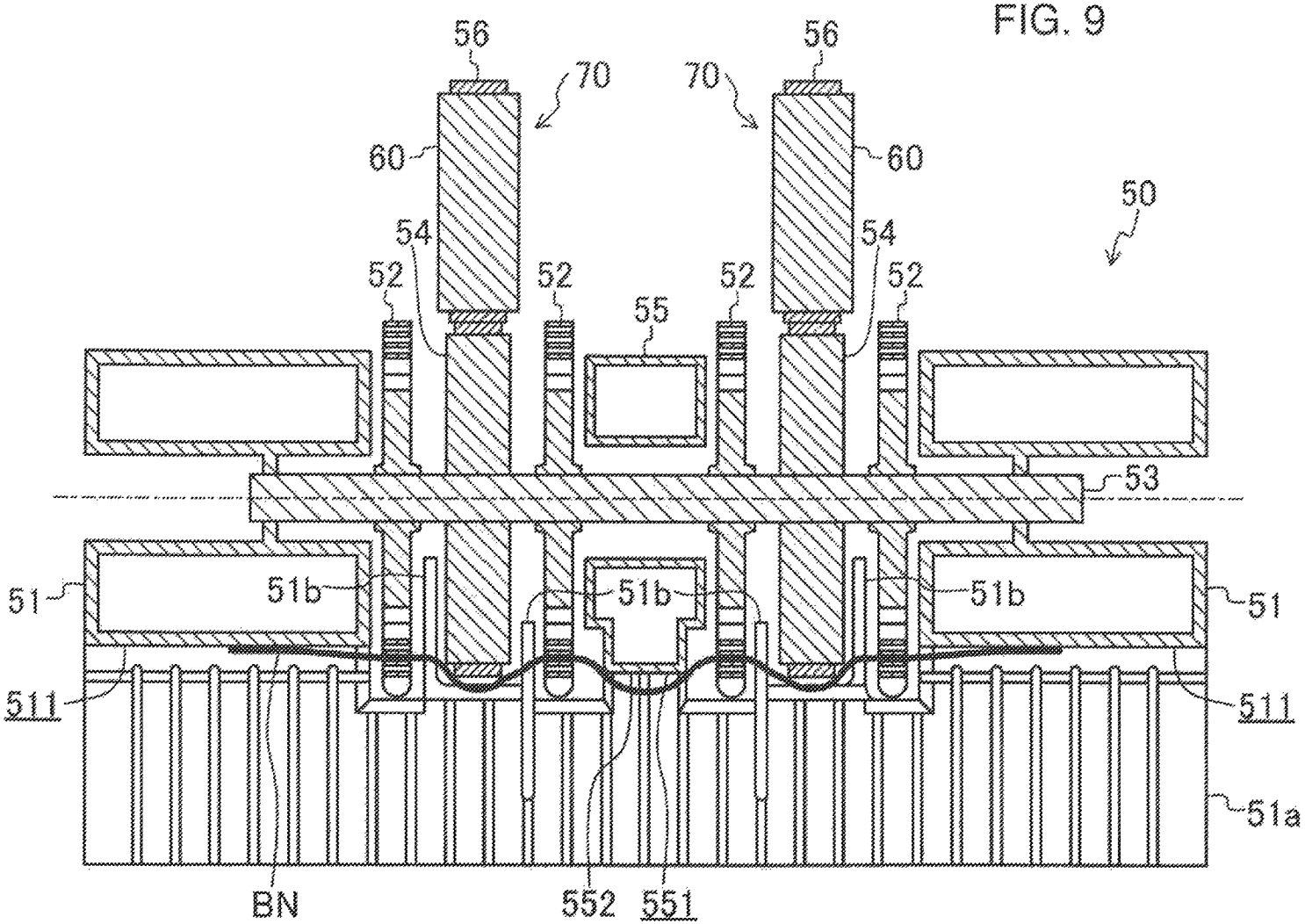
FIG. 9 is a cross-sectional view taken along a line IX-IX in FIG. 6.

As shown in FIGS. 3, 8, and 9, ribs 51*b* are disposed between the two stacking wheels 52 on the left side and the rotary roller 54 disposed between the two stacking wheel 52, and between the two stacking wheels 52 on the right side and the rotary roller 54 disposed between the two stacking wheels 52, respectively. Each rib 51*b* fills the gap between the stacking wheel 52 and the rotary roller 54. Each rib 51*b* extends upward from an upper end of the stopper 51*a*. A banknote transported by the stacking wheels 52 comes into contact with the ribs 51*b*, and is prevented from entering the gap between the stacking wheel 52 and the rotary roller 54.

As shown in FIG. 3 and FIG. 5, a circulation-type transport belt 56 is provided to be opposed to each rotary roller 54. In FIG. 4, illustration of the transport belt 56 is omitted.

Each transport belt 56 is stretched over a plurality of pulleys 58, 60, and 62, and a portion of the transport belt 56 is in contact with the outer circumferential surface of the rotary roller 54. A transport mechanism 70 is composed of the transport belts 56 and the plurality of pulleys 58, 60, and 62. Specifically, the transport belt 56 is in contact with the outer circumferential surface of the rotary roller 54, within a predetermined angle range at an upper part of the rotary roller 54.

Among the plurality of pulleys 58, 60, and 62, a certain one pulley (e.g., the pulley 60) is driven so as to rotate in a clockwise direction in FIG. 5, whereby the transport belt 56 is also circularly moved in the clockwise direction in FIG. 5. The rotary roller 54 is not fixed to the shaft 53 but is rotatable with respect to the shaft 53, and when the transport belt 56 is circularly moved, the rotary roller 54 rotates along with the transport belt 56. Thus, the rotary roller 54 rotates in the counter-clockwise direction in FIG. 5. At this time, the rotary roller 54 rotates at an angular velocity greater than that of the stacking wheel 52 such that the angular velocity of the rotary roller 54 is, for example, not less than 2 times but not greater than 10 times the angular velocity of the stacking wheel 52, more specifically, so that the angular velocity of the rotary roller 54 is, for example, 2.8 times the angular velocity of the stacking wheel 52.

A banknote transported from the transport unit 13 to the banknote stacking mechanism 50 is nipped between the rotary rollers 54 and the transport belts 56, and is transported to the gap between the vanes 52*b* of the rotating stacking wheels 52 by the transport belts 56 being driven.

As described above, the diameter of each rotary roller 54 is configured such that the outer circumferential surface of the rotary roller 54 is located outward relative to the outer circumferential surface of the base 52*a* of the stacking wheel 52 and is located inward relative to the circular region drawn by the tips of the vanes 52*b* of the stacking wheel 52 when the stacking wheel 52 rotates. Therefore, the banknote nipped between the rotary rollers 54 and the transport belts 56 is transported to the gap between the vanes 52*b*, in the upper part of the stacking wheel 52.

Even when a rear end portion of the banknote inserted between the vanes 52*b* of the stacking wheels 52 is discharged from between the rotary rollers 54 and the transport belts 56, since the friction member 541 is provided on the outer circumferential surface of each rotary roller 54 and each rotary roller 54 is rotated at an angular velocity greater than that of each stacking wheel 52, the banknote inserted between the vanes 52*b* of the stacking wheels 52 is pushed deeply into the gap between the vanes 52*b* (i.e., pushed toward the root side of the vanes 52*b*) due to a friction acting between each stacking wheel 52 and the outer circumferential surface of each rotary roller 54. This drawing-in function of the rotary rollers 54 prevents the banknote from being pushed back to the outside from between the vanes 52*b* of the stacking wheels 52 due to the elastic restoring force of the banknote, thereby preventing the banknote from being thrust out of the stacking wheels 52 before the leading end of the banknote comes into contact with the stopper 51*a*.

Then, the stacking wheels 52 rotate with the banknote being nipped between the vanes 52*b* of the stacking wheels 52, and the leading end of the banknote comes into contact with the stopper 51*a*, whereby the banknote is discharged from between the vanes 52*b* of the stacking wheels 52 to the outside, and stacked in the stacking unit 30. Thus, banknotes can be stacked in the stacking unit 30 in an aligned state.

In the banknote stacking mechanism 50, as shown in FIG. 3 and FIG. 4, a center guide 55 is provided between the two stacking wheels 52 located at the center side in the direction in which the shaft 53 extends (i.e., in the left-right direction in FIG. 3). The center guide 55 has a guide surface 551 having a cross section, the contour of which is curved in a substantially semicircular shape around the shaft 53. In addition, two outer guides 51 are provided on the sides of the two stacking wheels 52 located outward in the direction in which the shaft 53 extends. Each outer guide 51 has a second guide surface 511 having a cross section, the contour of which is curved in a substantially semicircular shape around the shaft 53. Each of the center guide 55 and the outer guides 51 is a fixed guide that does not rotate around the shaft 53. Each of the guide surfaces 551 and 511 comes into contact with a face of the banknote that is transported by rotation of the stacking wheels 52 while being inserted between the vanes 52*b* of the stacking wheels 52, thereby guiding the banknote so as to prevent the banknote from being thrust to the region between the two stacking wheels 52 in the center or to the regions outside the respective outer stacking wheels 52.

Each of the center guide 55 and the outer guides 51 has a function to control the amount of insertion of a banknote so that the banknote is not excessively inserted between the vanes 52*b* of the stacking wheels 52. As described above, in the banknote stacking mechanism 50, a banknote is inserted between the vanes 52*b* of the stacking wheels 52 by the rotary rollers 54 and the transport belts 56. This structure is effective in terms of stably inserting and holding a banknote between the vanes 52*b* of the miniaturized stacking wheels 52, but may cause folding or damage of the banknote because the banknote is excessively inserted between the vanes 52*b* when the rotation speed of the stacking wheels 52 is increased.

That is, the rotary roller 54 disposed adjacent to each stacking wheel 52 has a diameter larger than the diameter of the base 52*a* of the stacking wheel 52. Meanwhile, since the gap between a vane 52*b* and a neighbouring vane 52*b* in each stacking wheel 52 extends radially outward from the base 52*a* as is apparent from FIG. 5, the leading end of the banknote inserted between the vanes 52*b* is shifted radially inward with an increase in the amount of insertion of the banknote. Therefore, the trajectory of the leading end of the banknote that is gradually inserted between the vanes 52*b* with rotation of the stacking wheel 52 is gradually shifted radially inward in the stacking wheel 52 as shown by black dots in FIG. 6.

Figure 7:
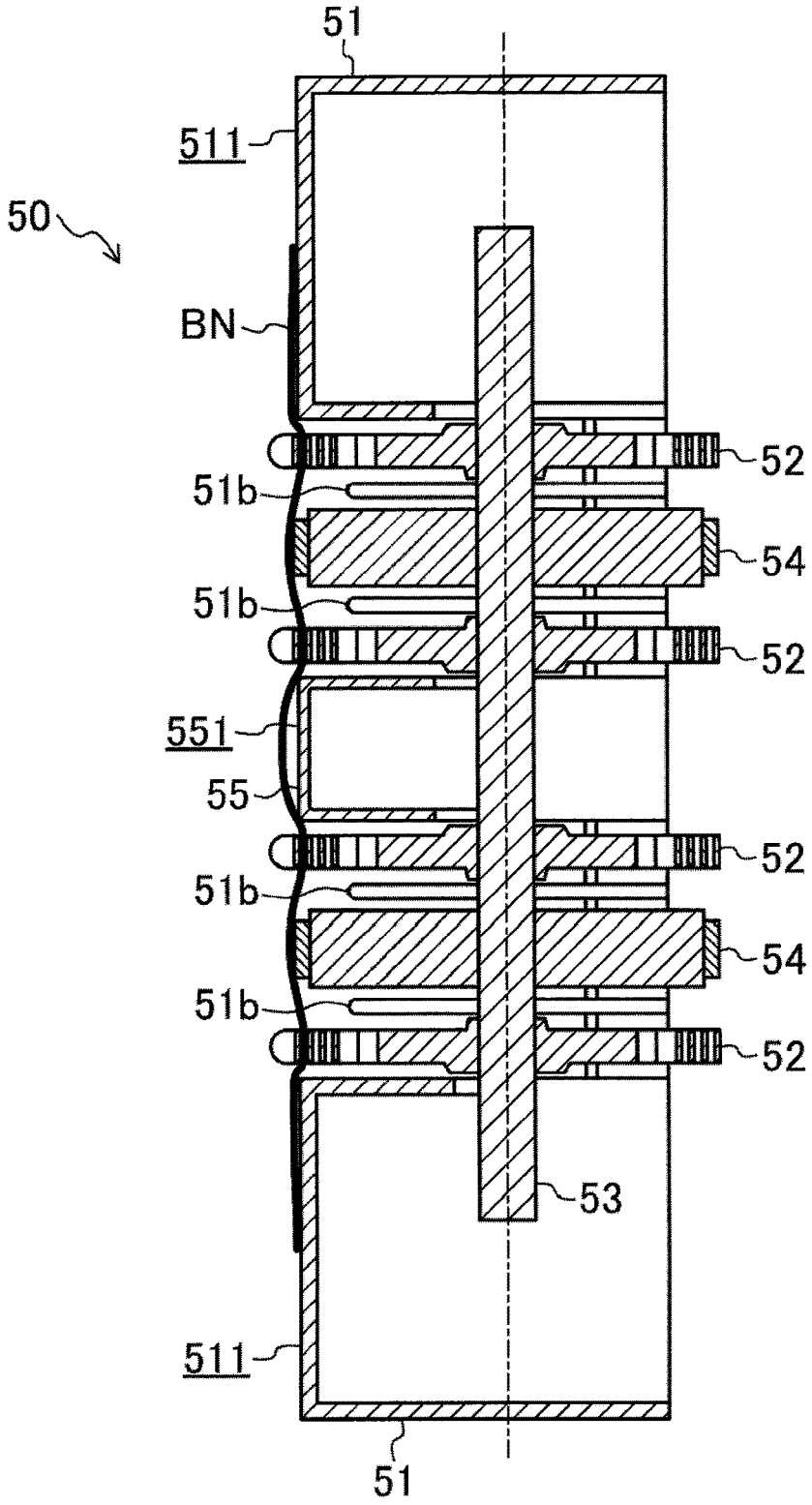
FIG. 7 is a cross-sectional view taken along a line VII-VII in FIG. 6.

The banknote inserted between the vanes 52*b* of the stacking wheels 52 is nipped between the vanes 52*b* and the outer circumferential surfaces of the rotary rollers 54. For example, as shown in FIG. 7, a banknote BN is bent in a wave-like shape between the stacking wheels 52 and the rotary rollers 54, and is held by the stacking wheels 52 and the rotary rollers 54. By bending the banknote BN in a wave-like shape, the banknote BN can be stably held between the vanes 52*b* of the stacking wheels 52 against the elastic restoring force of the banknote BN even when the stacking wheels 52 are miniaturized and the rotation speed of the stacking wheels 52 is increased.

However, as described above, the greater the amount of insertion of the banknote BN inserted between the vanes 52*b* of the stacking wheels 52 is, the more the banknote BN is shifted radially inward in the stacking wheels 52. Therefore, if the banknote BN is excessively inserted between the vanes 52*b*, the position at which the outer circumferential surfaces of the rotary rollers 54 come into contact with the face, of the banknote BN, facing radially inward greatly deviates in the radial direction from the position at which the vanes 52*b* come into contact with the face, of the banknote BN, facing radially outward. That is, the banknote BN, which is shaped in a wave-like shape by being nipped between the vanes 52*b* and the outer circumferential surfaces of the rotary rollers 54, is greatly bent so as to increase the amplitude of the wave, which causes the banknote BN to be folded. If the diameters of the guide surfaces 551 and 511 of the center guide 55 and the outer guides 51 are made equal to the diameter of the rotary rollers 54, the banknote BN is also greatly bent at portions nipped between the vanes 52*b* and the guide surfaces 551 and 511, which causes folding of the banknote BN more easily.

The greater the amount of insertion of the banknote BN inserted between the vanes 52*b* of the stacking wheels 52 is, the more the holding force for holding the banknote BN between the vanes 52*b* increases, whereby the banknote BN can be stably held between the vanes 52*b* of the stacking wheels 52. In this case, however, the banknote BN cannot easily come off from the vanes 52*b* when the leading end of the banknote BN hits the stopper 51*a*. In particular, when the rotation speed of the stacking wheel 52 is increased, an impact force generated when the leading end of the banknote BN hits the stopper 51*a* is increased. Therefore, the leading end of the banknote BN is damaged when the leading end of the banknote BN hits the stopper 51*a*.

In the banknote stacking mechanism 50, the amount of insertion of the banknote BN is controlled by the center guide 55 and the outer guides 51. Hereinafter, the structures of the center guide 55 and the outer guides 51 will be described in detail with reference to the drawings.

Among the center guide 55 and the outer guides 51, the center guide 55 is configured to regulate insertion of the banknote BN between the vanes 52*b*. On the other hand, the outer guides 51 are configured to allow insertion of the banknote BN between the vanes 52*b*.

First, the outer guides 51 will be described. The second guide surface 511 of each outer guide 51 has a substantially semicircular shape, as described above. More specifically, as shown in FIG. 6, regions having angles θ1 and θ2, which are delimited by two-dot chain lines, correspond to a region of the second guide surface 511 of each outer guide 51. For easy understanding, the shape of the second guide surface 511 of the outer guide 51 is indicated by a solid line in FIG. 6. In the first region θ1, of the second guide surface 511, located upstream in the rotation direction of the stacking wheel 52, the second guide surface 511 has an arc shape having the same diameter as the outer circumferential surface of the rotary roller 54. The first region θ1 corresponds to a region in which the transport belt 56 is in contact with the outer circumferential surface of the rotary roller 54. In the first region θ1, the second guide surface 511 has the arc shape having the same diameter as the outer circumferential surface of the rotary roller 54, and thus guides the banknote BN so that the banknote BN is assuredly inserted between the vanes 52*b* of the stacking wheels 52. In the first region θ1, the second guide surface 511 has substantially the same shape as the trajectory of the leading end of the banknote BN.

The second region θ2, which is located downstream of the first region θ1 in the rotation direction, corresponds to a region in which the banknote BN discharged from between the transport belts 56 and the rotary rollers 54 is gradually inserted between the vanes 52*b* in accordance with rotation of the stacking wheels 52. In this second region θ2, the second guide surface 511 has a curved shape along the trajectory of the leading end of the banknote BN so as to correspond to the banknote BN between the vanes 52*b* being shifted radially inward in the stacking wheels 52 as the banknote BN is gradually inserted. Also in the second region θ2, the second guide surface 511 has substantially the same shape as the trajectory of the leading end of the banknote BN. Thus, the second guide surface 511 allows the banknote BN to be inserted between the vanes 52*b* of the stacking wheels 52.

A most downstream side, in the rotation direction, of the second guide surface 511 is connected to an upper end of the stopper 51*a*. A portion, of the second guide surface 511, in front of the connected portion is configured to be a flat surface that is straight in the horizontal direction. Thus, there is a deviation between the shape of the second guide surface 511 and the trajectory of the leading end of the banknote BN. This configuration is made in consideration of removal of a mold when forming, by molding, a member in which the stopper 51*a*, the center guide 55, and the outer guides 51 are integrated. The second guide surface 511 may be configured to be connected to the stopper 51*a* while maintaining the curved shape along the trajectory of the leading end of the banknote BN indicated by black dots in FIG. 6.

Meanwhile, the guide surface 551 of the center guide 55, as shown in FIG. 6 (the guide surface 551 of the center guide 55 is also indicated by a solid line in FIG. 6), has an arc shape having the same diameter as the outer circumferential surface of the rotary roller 54, in the first region θ1 located upstream in the rotation direction of the stacking wheel 52. In the first region θ1 on the upstream side, the guide surface 551 of the center guide 55 has substantially the same shape as the trajectory of the leading end of the banknote BN. Thereby, the guide surface 551 of the center guide 55 also guides the banknote BN so that the banknote BN is assuredly inserted between the vanes 52*b* of the stacking wheels 52. The guide surface 551 of the center guide 55 may be curved so as to have, in the first region θ1, a diameter smaller than that of the trajectory of the leading end of the banknote BN.

In the second region θ2 located downstream in the rotation direction, the guide surface 551 has a curved shape having a diameter that increases with respect to the trajectory of the leading end of the banknote BN as the banknote BN between the vanes 52*b* is shifted radially inward with an increase in the amount of insertion of the banknote BN. As shown in FIG. 6, the guide surface 551 is configured such that the difference in diameter between the guide surface 551 and the trajectory of the leading end of the banknote BN is gradually increased toward the downstream side in the rotation direction. That is, the diameter of the guide surface 551 is gradually increased from the upstream side to the downstream side in the rotation direction of the stacking wheels 52. The most downstream portion of the guide surface 551 is connected to the stopper 51*a*, and a portion, of the guide surface 551, in front of the connected portion is also configured to be a flat surface that is straight in the horizontal direction, similarly to the second guide surface 511. Instead of providing such a flat surface, the guide surface 551 may be configured such that the different in diameter between the guide surface 551 and the trajectory of the banknote BN is further increased in the most downstream portion thereof in the rotation direction.

In the second region θ2 on the downstream side, since the center guide 55 guides the banknote BN so as to shift the banknote BN radially outward, excessive insertion of the banknote BN between the vanes 52*b* is suppressed.

With the center guide and the outer guides configured as described above, the banknote BN inserted between the vanes 52*b* is nipped between the second guide surfaces 511 of the outer guides 51 and the vanes 52*b* and between the guide surface 551 of the center guide 55 and the vanes 52*b*, and is bent in a wave-like shape, as shown in FIG. 7. As shown in FIG. 8, on the downstream side in the rotation direction of the stacking wheels 52, the amount of insertion of the banknote BN between the vanes 52*b* is increased. However, since the second guide surface 511 of each outer guide 51 has a curved shape along the trajectory of the leading end of the banknote BN, the banknote BN is hardly bent between the second guide surfaces 511 and the vanes 52*b*. On the other hand, since the guide surface 551 of the center guide 55 has a shape having a diameter larger than that of the trajectory of the leading end of the banknote BN, the banknote BN is bent relatively greatly between the guide surface 551 and the vanes 52*b*. Further, the banknote BN is greatly bent between the stacking wheels 52 and the rotary rollers 54. The greater the angle of bending of the banknote BN is, the more the holding force against the elastic restoring force of the banknote BN is increased, whereby the banknote BN can be stably held between the vanes 52*b*. In particular, since the stacking wheels 52 are miniaturized, the curvature of the banknote BN that is inserted between the vanes 52*b* and bent along the outer circumferences of the stacking wheels 52 is relatively large, and the elastic restoring force of the banknote BN is increased accordingly. However, since the holding force is increased by the above-described center guide 55 and the outer guides 51, the banknote BN can be stably held. As described above, in the banknote stacking mechanism 50, each banknote BN is assuredly caused to hit the stopper 51*a*, whereby banknotes BN can be stacked in an aligned state.

Meanwhile, the center guide 55 suppresses excessive insertion of the banknote BN between the vanes 52*b*, whereby the banknote BN bent in a wave-like shape is prevented from being folded.

Although excessive insertion of the banknote BN between the vanes 52*b* is suppressed, since the diameter of the guide surface 551 of the center guide 55 is large, the banknote BN nipped between the guide surface 551 of the center guide 55 and the vanes 52*b* is relatively greatly bent immediately before the banknote BN hits the stopper 51*a*, as shown in FIG. 8. As a result, the holding force at the center portion in the longitudinal direction of the banknote BN is relatively great. In this state, if the leading end of this banknote BN hits the stopper 51*a*, the leading end of the banknote BN may be damaged.

Figure 10:
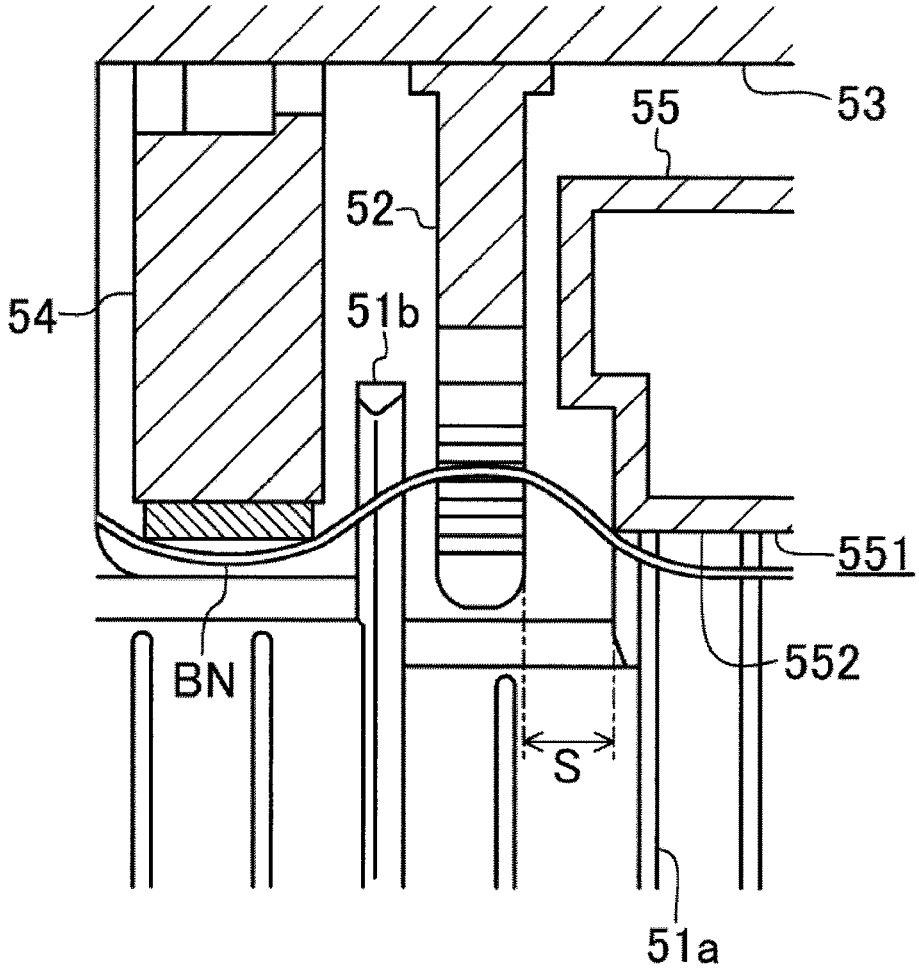
FIG. 10 is an enlarged cross-sectional view of a part, around a stacking wheel, of the structure shown in FIG. 9.
Figure 11:
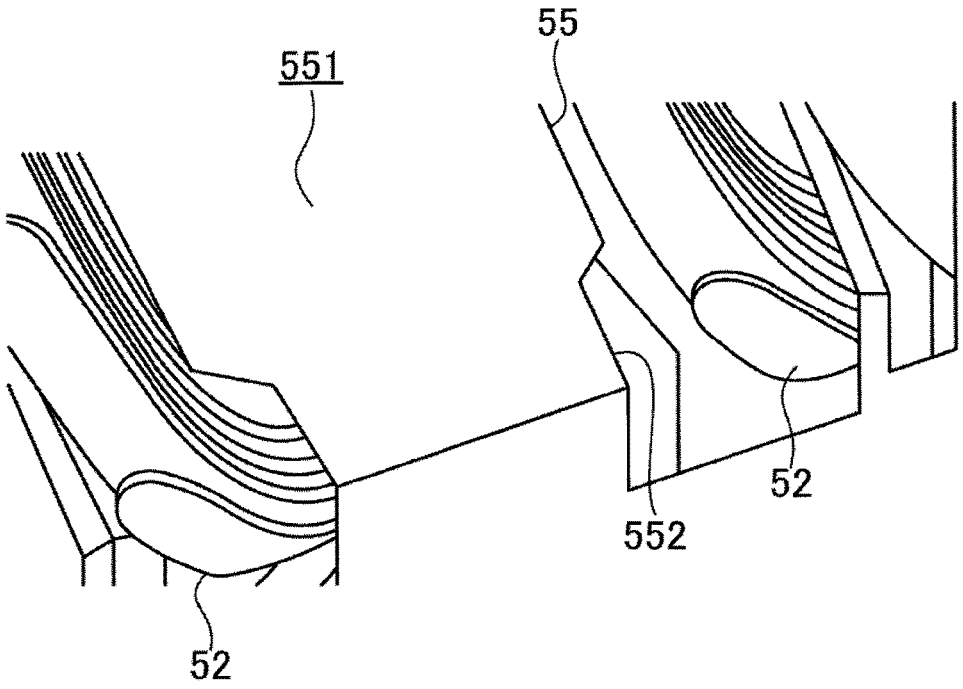
FIG. 11 is a perspective view showing, in an enlarged manner, a joint portion of a center guide and a stopper.

Therefore, in the banknote stacking mechanism 50, the center guide 55 is provided with a holding force reduction structure configured to reduce the holding force at a position immediately before the stopper 51*a*. Specifically, the holding force reduction structure is configured by a width reduction part 552 that reduces the width of the guide surface 551 at a position immediately before the stopper 51*a*, as shown in FIG. 9 to FIG. 11. As shown in FIG. 10, the width reduction part 552 causes an increase in a space S between the guide surface 551 of the center guide 55 and the stacking wheel 52 adjacent to the guide surface 551, and therefore the angle of bending of the banknote BN nipped between the guide surface 551 and the stacking wheels 52 becomes less steep, as is apparent from comparison between FIG. 8 and FIG. 9. As a result, the holding force at the center portion in the longitudinal direction of the banknote BN is reduced, and when the banknote BN hits the stopper 51*a*, the banknote BN comes off from between the vanes 52*b* of the stacking wheels 52 without damaging the leading end of the banknote BN.

It is also conceivable that the two guide surfaces 511 of the outer guides 51 are configured to suppress insertion of the banknote BN by replacing the shape of the guide surface 551 of the center guide 55 with the shape of the guide surface 511 of each outer guide 51. However, while the outer guides 51 are guides that come into contact with the face, of the banknote BN, at both end portions in the longitudinal direction of the banknote BN, the position of the banknote BN in the longitudinal direction thereof, which has been transported in the banknote processing machine 1 to reach the stacking unit 30, is not always constant, and if the placement position of the banknote BN on the hopper 11 deviates, the position, in the longitudinal direction, of the banknote BN that reaches the stacking unit 30 may be biased to one side.

In the banknote stacking mechanism 50, if the position of a banknote in the longitudinal direction thereof is biased to one side, one of the two outer guides 51 comes into contact with the face, of the banknote, on the one side in the longitudinal direction and guides the banknote, thereby suppressing insertion of the banknote between the vanes 52*b*, while the other outer guide 51 hardly comes into contact with the face, of the banknote, on the other side, so that the amount of insertion of the banknote cannot be suppressed. As a result, the banknote may be inclined while being transported by the stacking wheels 52, and may not be stacked in an aligned state in the stacking unit 30.

Meanwhile, the center guide 55 assuredly comes into contact with the face of the banknote at a portion, of the banknote, in the center in the longitudinal direction, even when the position of the banknote in the longitudinal direction thereof deviates. Therefore, the amount of insertion of the banknote can be suppressed without inclination of the banknote, resulting in an advantage that the banknote can be stably stacked in the stacking unit 30.

The holding force reduction structure is not necessarily configured by the above-described width reduction part 552, and may have configurations as follows, for example.

Figure 12:
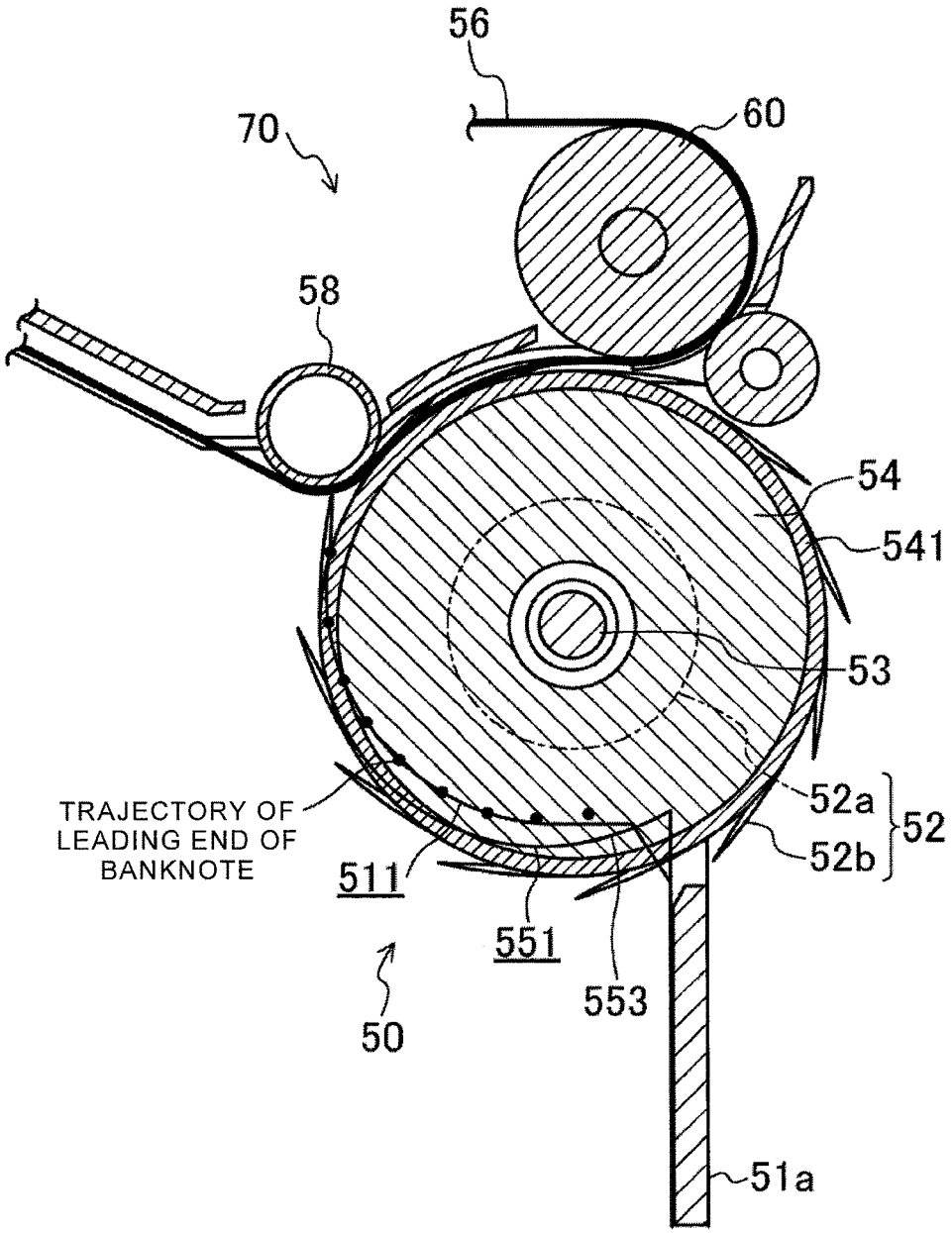
FIG. 12 is a diagram corresponding to FIG. 6 according to a modification.

FIG. 12 shows an example of a holding force reduction structure which is configured by a diameter reduction part 553 which reduces, in front of the stopper 51*a*, the diameter of the guide surface 551 of the center guide 55. The diameter reduction part 553 causes the angle of bending of the banknote BN nipped between the guide surface 551 of the center guide 55 and the vanes 52*b* to be less steep, whereby the holding force in the center portion in the longitudinal direction of the banknote BN can be reduced. The holding force reduction structure may be configured by combining the width reduction part 552 shown in FIG. 9 to FIG. 11 and the diameter reduction part 553 shown in FIG. 12.

Figure 13:
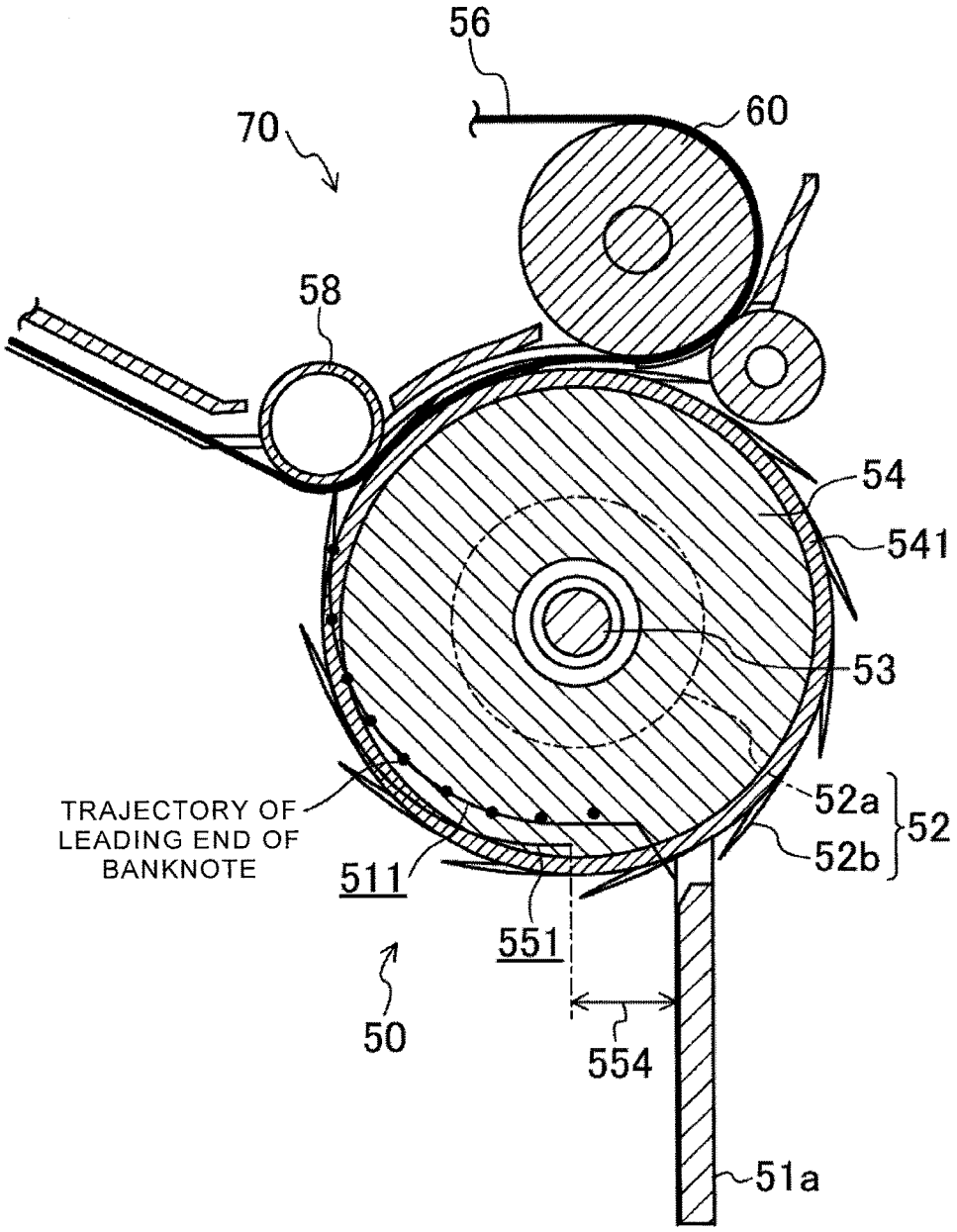
FIG. 13 is a diagram corresponding to FIG. 6 according to a modification.

FIG. 13 shows an example of a holding force reduction structure which is configured by an omission part 554 in which a portion, in front of the stopper 51*a*, of the guide surface 551 of the center guide 55 is omitted. This omission part 554 causes the banknote BN not to be nipped between the guide surface 551 of the center guide 55 and the vanes 52*b*, whereby the holding force in the center portion in the longitudinal direction of the banknote BN can be reduced.

The technique disclosed herein is not limited to application to the banknote processing machine 1 shown in FIG. 1, and can be widely applied to any banknote handing apparatus including the banknote stacking mechanism 50 having stacking wheels.

Further, subjects to be handled are not limited to banknotes, and the technique disclosed herein may be applied to paper sheet stacking mechanisms and paper sheet handling devices in which general paper sheets such as checks, negotiable instruments, and the like are stacked.

What is claimed is:

1. A paper sheet stacking mechanism comprising:

a stacking unit which stacks paper sheets therein in a stacking region;

a pair of stacking wheels, each stacking wheel having a base and a plurality of vanes formed on an outer surface of the base, the pair of stacking wheels transporting a paper sheet sandwiched between the vanes to the stacking unit by rotating in a rotation direction about a rotary shaft;

a transport unit which transports the paper sheets to the pair of stacking wheels;

a guide provided between the pair of stacking wheels;

a pair of rotary rollers provided to sandwich the pair of stacking wheels therebetween, outer guides provided to sandwich the pair of rotary rollers therebetween, and a stopper which hits a leading end of the paper sheet sandwiched between the vanes, wherein the guide and the outer guides come into contact with a face of the paper sheet sandwiched between the vanes, the guide is formed to have a diameter about the rotary shaft, the diameter being larger than a second diameter of the outer guides, at least in a region closer to the stacking region than to the rotary shaft as viewed in a direction of extension of the rotary shaft, the guide includes a holding force reduction structure configured to reduce, in front of the stopper, a holding force for holding the paper sheet sandwiched between the vanes, and the holding force reduction structure is a structure which increases a space between the guide and each stacking wheel by reducing a width of the guide in the rotation direction, in front of the stopper.

2. The paper sheet stacking mechanism according to claim 1, wherein a base of the rotary roller has a larger diameter than the base of the stacking wheel as viewed in the direction of extension of the rotary shaft, and the guide has such a shape that follows a trajectory of a leading end of the paper sheet sandwiched between the vanes, or the guide has a smaller diameter than the trajectory in a first region in the rotation direction as viewed in the direction of extension of the rotary shaft, and has a larger diameter than the trajectory in a second region downstream of the first region in the rotation direction.

3. The paper sheet stacking mechanism according to claim 2, wherein the stopper is arranged downstream of the second region in the rotation direction.

4. The paper sheet stacking mechanism according to claim 1, wherein the holding force reduction structure is a structure in which the diameter of the guide is reduced in front of the stopper as viewed in the direction of extension of the rotary shaft.

5. The paper sheet stacking mechanism according to claim 1, further including a pair of outer stacking wheels provided to sandwich the pair of rotary rollers therebetween, and rotates in the rotation direction.

6. The paper sheet stacking mechanism according to claim 5, wherein the outer guides are provided outside the pair of second stacking wheels.

7. The paper sheet stacking mechanism according to claim 1, wherein friction members are provided on outer surfaces of the rotary rollers.

8. A paper sheet handling device including the paper sheet stacking mechanism according to claim 1.

9. The paper sheet stacking mechanism according to claim 1, further including a transport belt which is arranged to be in contact with the pair of rotary rollers, and transports the paper sheets transferred from the transport unit to the pair of stacking wheels.

10. The paper sheet stacking mechanism according to claim 9, wherein the rotary rollers are rotated by the transport belt, and the rotary rollers are rotated at a higher rotation speed than the stacking wheels.

11. A paper sheet stacking mechanism comprising:

a stacking unit configured to stack paper sheets therein;

a pair of stacking wheels provided to be rotatable about a rotary shaft, each stacking wheel having vanes extending outward in a direction opposite to a rotation direction of the stacking wheel, the pair of stacking wheels being configured to transport a paper sheet inserted between the vanes to the stacking unit;

two rotary rollers rotatably provided outside and adjacent to the pair of stacking wheels, the rotary rollers being configured to transport the paper sheet to the stacking unit in cooperation with the stacking wheels;

transport mechanisms provided to be opposed to the two rotary rollers, respectively, the transport mechanisms being configured to transport the paper sheet nipped between the transport mechanisms and the rotary rollers, at a speed higher than a rotation speed of the stacking wheels, thereby to insert the paper sheet between the vanes of the stacking wheels;

a guide provided between the pair of stacking wheels, the guide having a guide surface configured to guide the paper sheet by coming into contact with a face of the paper sheet that is inserted between the vanes of the stacking wheels by the transport mechanisms and transported in accordance with rotation of the stacking wheels; and outer guides provided to sandwich the two rotary rollers therebetween, and each having a second guide surface, and a stopper configured to, when the leading end of the paper sheet transported in accordance with rotation of the stacking wheel hits the stopper, extract the paper sheet from between the vanes and stack the paper sheet in the stacking unit, wherein the guide surface has a curved shape having a diameter about the rotary shaft, the diameter being larger than a second diameter of the second guide surface, the guide includes a holding force reduction structure configured to reduce, in front of the stopper, a holding force for holding the paper sheet nipped between the guide surface and the vanes, and the holding force reduction structure is a structure which increases a space between the guide surface and each stacking wheel by reducing a width of the guide surface in the direction of the rotary shaft, in front of the stopper.

12. A paper sheet stacking mechanism comprising:

a stacking unit configured to stack paper sheets therein;

a pair of stacking wheels provided to be rotatable about a rotary shaft, each stacking wheel having vanes extending outward in a direction opposite to a rotation direction of the stacking wheel, the pair of stacking wheels being configured to transport a paper sheet inserted between the vanes to the stacking unit;

two rotary rollers rotatably provided outside and adjacent to the pair of stacking wheels, the rotary rollers being configured to transport the paper sheet to the stacking unit in cooperation with the stacking wheels;

transport mechanisms provided to be opposed to the two rotary rollers, respectively, the transport mechanisms being configured to transport the paper sheet nipped between the transport mechanisms and the rotary rollers, at a speed higher than a rotation speed of the stacking wheels, thereby to insert the paper sheet between the vanes of the stacking wheels;

a guide provided between the pair of stacking wheels, the guide having a guide surface configured to guide the paper sheet by coming into contact with a face of the paper sheet that is inserted between the vanes of the stacking wheels by the transport mechanisms and transported in accordance with rotation of the stacking wheels;

second guides provided outside the two rotary rollers, respectively, each second guide having a second guide surface curved around the rotary shaft, the second guide surface being configured to guide the paper sheet when coming into contact with a face of the paper sheet that is inserted between the vanes of the stacking wheels by the transport mechanism and transported in accordance with rotation of the stacking wheels; and two second stacking wheels provided outside and adjacent to the two rotary rollers so as to be coaxial with the stacking wheels and rotatable, each second stacking wheel having vanes extending outward in a direction opposite to a rotation direction of the second stacking wheel, the second stacking wheels being configured to transport the paper sheet inserted between the vanes, to stacking unit, in cooperation with the stacking wheels, wherein the guide surface has a curved shape having a diameter about the rotary shaft, the diameter being larger than a second diameter of the second guide surface, and the second guides are provided outside and adjacent to the second stacking wheels, respectively.

* * * * *